US006311032B1

(12) United States Patent
Carter, Jr. et al.

(10) Patent No.: US 6,311,032 B1
(45) Date of Patent: Oct. 30, 2001

(54) ALIGNMENT DEVICE AND METHOD FOR ALIGNING INPUT/OUTPUT DEVICES WITH PRINTERS

(75) Inventors: Scott K. Carter, Jr., Caldwell; Kevin Falk, Boise, both of ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/689,298

(22) Filed: Oct. 11, 2000

(51) Int. Cl.[7] ..... G03G 15/00; B65H 33/04; B65H 39/02

(52) U.S. Cl. ..... 399/107; 270/58.01; 270/58.14; 399/403

(58) Field of Search ..... 399/107, 110, 399/403, 404; 270/58.01, 58.14, 58.18

(56) References Cited

U.S. PATENT DOCUMENTS

| | | | | |
|---|---|---|---|---|
| 3,830,554 | | 8/1974 | Moussaian et al. | 312/30 |
| 4,084,214 | | 4/1978 | Eppich | 361/394 |
| 4,251,153 | | 2/1981 | Levine | 355/3 R |
| 4,405,225 | * | 9/1983 | Perrault | 399/403 |
| 4,449,812 | * | 5/1984 | Furuichi et al. | 399/403 |
| 4,645,275 | | 2/1987 | Pucci | 312/244 |
| 4,688,786 | * | 8/1987 | Takahata | 399/403 X |
| 4,691,237 | | 9/1987 | Shimizu | 358/256 |
| 4,761,094 | | 8/1988 | Amagaya | 403/341 |
| 4,922,125 | | 5/1990 | Casanova et al. | 307/149 |
| 4,962,430 | | 10/1990 | Hiroki et al. | 358/296 |
| 5,007,760 | | 4/1991 | Mullen et al. | 403/13 |
| 5,007,762 | | 4/1991 | Duran | 403/341 |
| 5,101,240 | | 3/1992 | Pendell et al. | 355/323 |
| 5,180,232 | | 1/1993 | Chadima, Jr. et al. | 400/88 |
| 5,542,655 | * | 8/1996 | Murakami | 270/58.14 X |
| 5,600,445 | | 2/1997 | Omi | 358/296 |
| 5,630,578 | | 5/1997 | Naramore et al. | 270/58.08 |
| 5,666,595 | * | 9/1997 | Sameshima et al. | 399/110 |
| 5,782,467 | * | 7/1998 | Johnson | 270/58.18 X |
| 6,259,872 | * | 7/2001 | Fukunaga et al. | 399/107 |

* cited by examiner

*Primary Examiner*—Fred L Braun
(74) *Attorney, Agent, or Firm*—James R. McDaniel

(57) ABSTRACT

This invention relates to alignment devices for input/output devices to printers. Such structures of this type, generally, employ a locating foot that is attached to the input/output device which fits into a locating and referencing means on the underside of the printer stand or under—mounted input device.

8 Claims, 5 Drawing Sheets

ALIGNMENT DEVICE AND METHOD FOR ALIGNING INPUT/OUTPUT DEVICES WITH PRINTERS

FIELD OF THE INVENTION

This invention relates to alignment devices for aligning input/output devices to printers. Such structures of this type, generally, employ a locating foot that is attached to the input/output device which fits into a locating and referencing means on the underside of the printer stand or under—mounted input device.

DESCRIPTION OF THE RELATED ART

It is known, in printer/paper handling devices, to employ various alignment devices. Exemplary of such alignment devices are U.S. Pat. No. 5,101,240 ('240) to P. T. Pendell et. al., entitled "System for Aligning a Printer with a Finisher" and U.S. Pat. No. 5,630,578 ('578) to R. A. Naramore et. al., entitled "Low Manual Effort System for Removably Mounting Paper Handling Modules to Reproduction Machines." While the ('240) and ('578) patents demonstrate various apparatus and methods for aligning a printer with an input/output device, these patents do not employ a locating foot. Consequently, a more advantageous alignment system would be presented if such a locating foot where utilized.

It is apparent from the above that there exists a need in the art for an alignment system which is lightweight through simplicity of parts and uniqueness of structure, and which at least equals the alignment characteristics of the known alignment devices, but which at the same time employs a locating foot that is attached to the input/output device. It is a purpose of this invention to fulfill this and other needs in the art in a manner more apparent to the skilled artisan once given the following disclosure.

SUMMARY OF THE INVENTION

Generally speaking, this invention fulfills these needs by providing an alignment and stabilizing device for aligning an input/output device with a printer, comprising an input/output device having a locking means, the first alignment means hingedly attached to a lower end of the input/output device, wherein the first alignment means is comprised of a unitary base means, a pivot means located substantially within one end of the base means and operatively connected to the input/output device, and a base height adjustment means operatively connected to the other end of the base means, and a printer means, wherein the printer means is comprised of a second alignment means which interacts with the first alignment means and a receiving means for receiving a locking means.

In certain preferred embodiments, the base means is constructed of a durable polymeric material. Also, the base height adjustment means includes a roller or a slider. Finally, the locking means includes a latch.

In another further preferred embodiment, the alignment device allows for a quick and precise alignment of the input/output device with the printer.

The preferred alignment device, according to this invention, offers the following advantages: lightness in weight; ease of assembly and repair; good stability; excellent durability; excellent alignment; and good economy. In fact, and many of the preferred embodiments, these factors of weight, assembly, durability, and alignment are optimized to the extent that is considerably higher than heretofore achieved in prior, known alignment devices.

The above and other features of the present invention, which will become more apparent as description proceeds, are best understood by considering the following detailed description in conjunction with the accompanying drawings, wherein like characters represent like parts throughout the several views and in which:

DETAILED DESCRIPTION OF THE INVENTION

Figure 1:
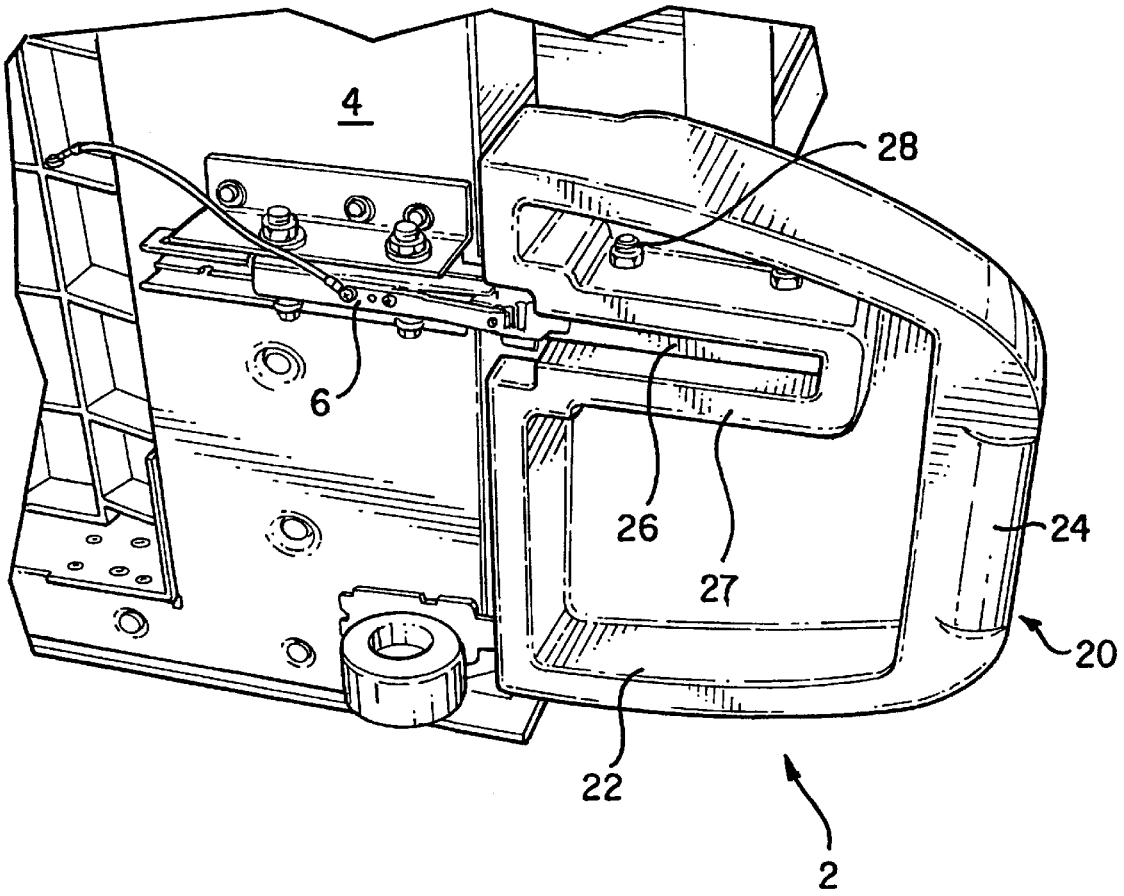
FIG. 1 is a bottom view of an alignment device, according to the present invention.

With reference first to FIG. 1, there is illustrated an advantageous environment for the use of the concepts of this invention. In particular, FIG. 1 illustrates alignment device or foot 20 which is pivotally attached to a conventional input/output device 4 at conventional pivot 6. Alignment device 20 includes, in part, unitary base 22, height adjustment means 24, pivot arm 26, pivot arm reinforcement means 27, and conventional pivot arm fasteners 28.

Base 22 and pivot arm reinforcement means 27 are, preferably, constructed of any suitable, durable polymeric material by any conventional technique, such as molding. Height adjustment means 24 can be constructed of a slider which is constructed of any suitable, durable polymeric material or, instead, a roller can be inserted into the location where the slider is placed. Various sizes of sliders or rollers can be utilized in order to adjust the height of alignment device 20 with respect to input/output device 4 and/or printer 50 (FIG. 4).

Figure 2:
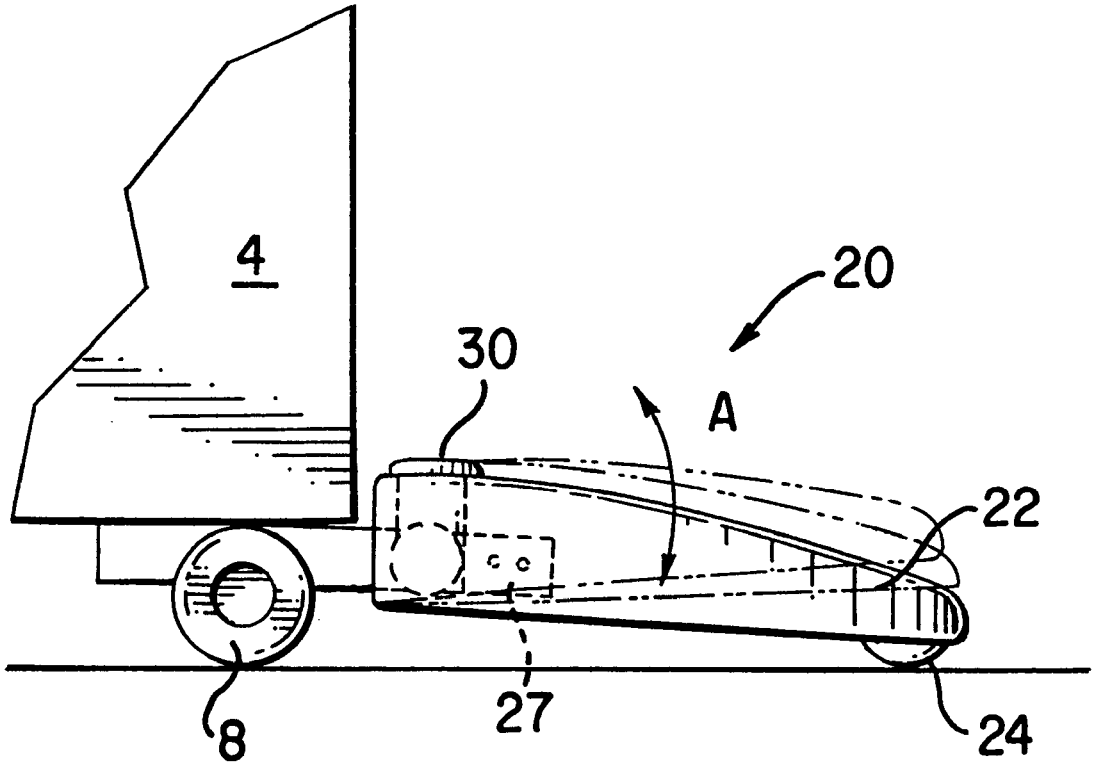
FIG. 2 is a side plan view of the alignment device of FIG. 1, according to the present invention.

As shown in FIG. 2, alignment device 20 is located at the bottom of input/output device 4 near roller 8. However, it is to be understood that alignment device 20 can be located at the bottom of printer 50 and alignment pins 52 (FIG. 5) can be located at the bottom of input/output device 4. As can be seen in FIG. 2, the end user merely pushes down on release mechanism 30 in order to pivot alignment device 20 up towards input/output device 4 along the directions of arrows A.

Figure 3:
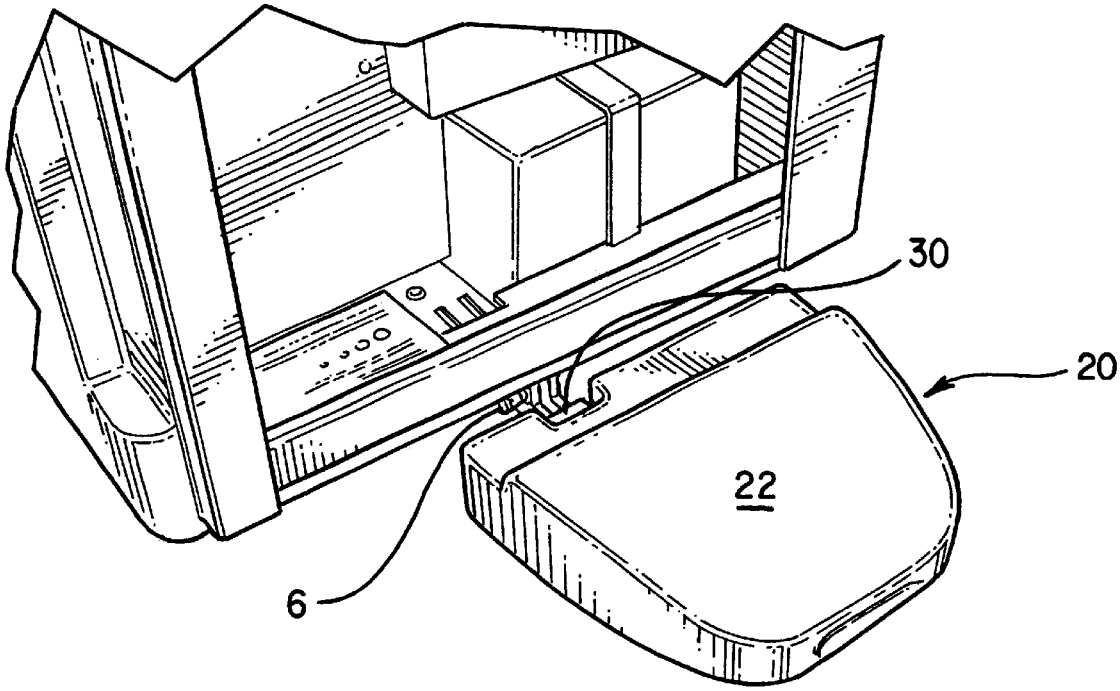
FIG. 3 is a top view of the alignment device of FIG. 1, according to the present invention.

As shown in FIG. 3, alignment device 20 is located in its down position. Release button 30 is also illustrated.

Figure 4:
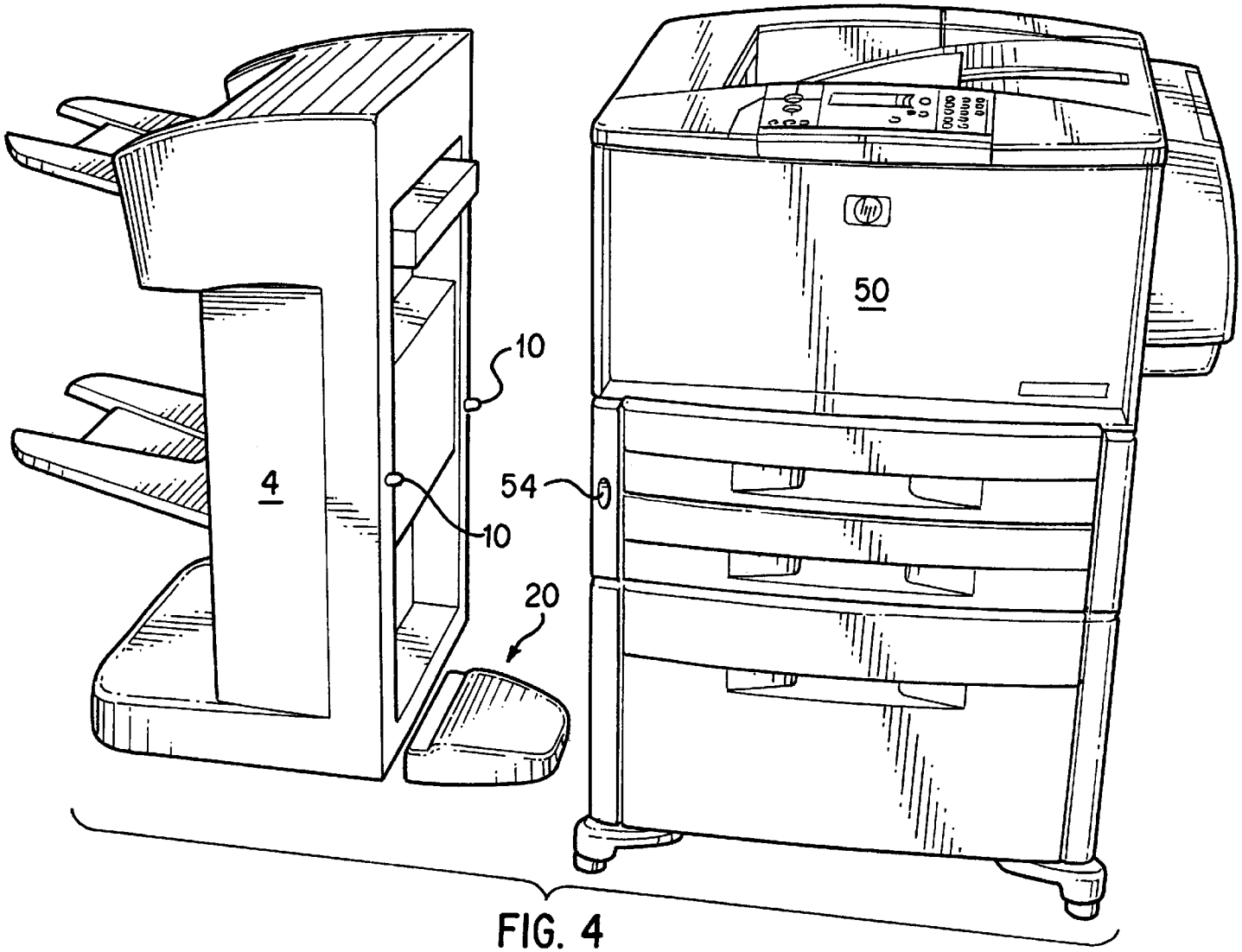
FIG. 4 is a schematic illustration of the alignment device in use, according to the present invention.

FIG. 4 illustrates the initial alignment of input/output device 4 and conventional printer 50. Conventional latches 10 on input/output device 4 are also illustrated. As can be seen in FIG. 4, latches 10 interact with conventional holes 54 in printer 50 in order to keep input/output device 4 attached to printer 50. Conventional electronic cables (not shown) are attached between input/output device 4 and printer 50 so that they can electronically interact with each other. It is to be understood that latch 10 and holes 54 would be eliminated by providing a conventional locking device on the outside of alignment device 20 which interacts with alignment pins 52.

Figure 5:
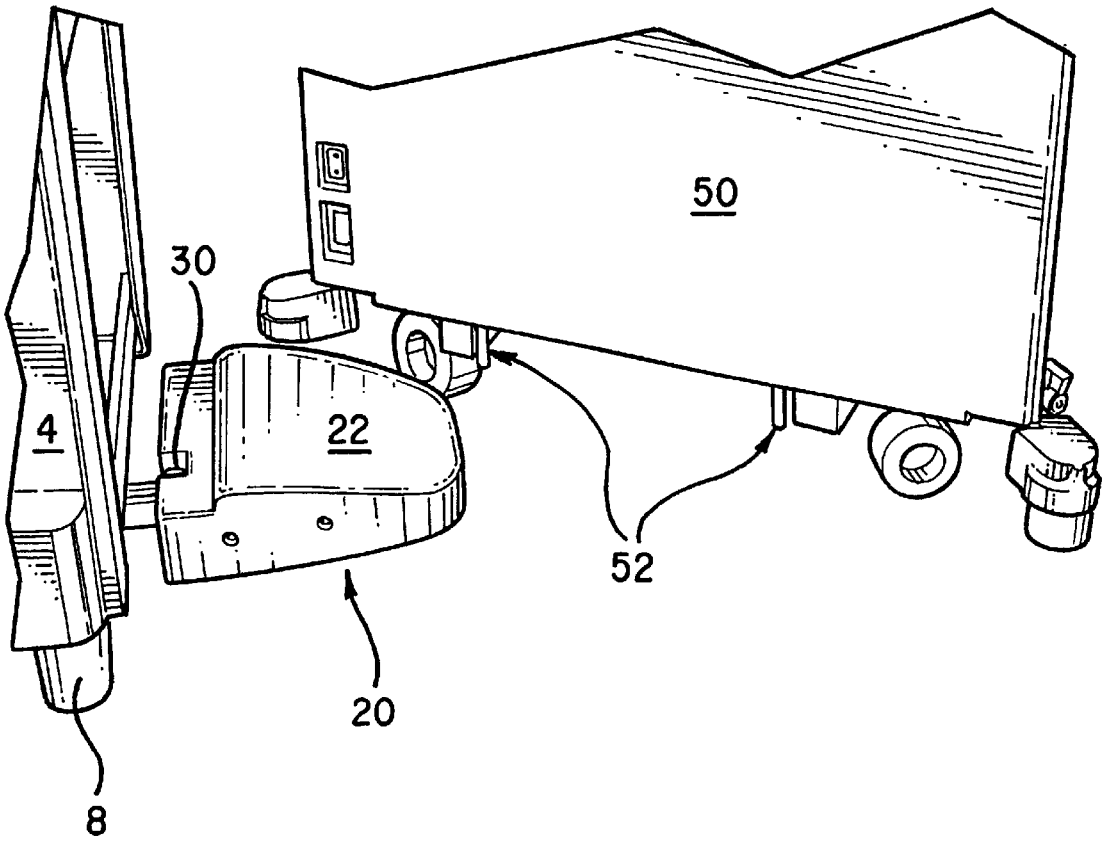
FIG. 5 is a schematic illustration of the alignment device on the input/output device and the alignment pins on the printer, according to the present invention.

Finally, FIG. 5 illustrates the vertical alignment pins 52 which are rigidly attached to the underside of the printer 50. Pins 52 are conventionally attached to printer 50 and allow precise alignment of alignment device 20 within the bottom of printer 50.

In order to prove the efficacy of the present invention, the following operational example is provided. If, for example, there is a paper jam between input/output device 4 and conventional printer 50, the end user merely releases latches 10 and pulls input/output device 4 from conventional printer 50. Due to the fact that there is no rail connection, as discussed above with respect to the prior art, the end user can turn input/output device 4 in any direction in order to separate input/output device 4 from printer 50. Due to this unique construction, input/output device 4 and printer 50 can be located in a relatively small area. Finally, alignment device 20 can be lifted out of the way by pushing release button 30 and rotating it towards input/output device 4.

After input/output device 4 has been separated from printer 50, the end user can easily reach the paper jam and remove the jammed paper (FIG. 4). Once the jammed paper has been removed, alignment device 20 can be swung downward into place. Input/output device 4 is then pushed towards printer 50 such that alignment device 20 interacts with vertical alignment pins 52 in order to precisely online input/output device with printer 50 (FIG. 5).

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. An alignment device for aligning an input/output device with a printer, wherein said device is comprised of:

an input/output device having a locking means;

a first alignment means hingedly attached to a lower end of said input/output device, wherein said first alignment means is comprised of a unitary base means, a pivot means located substantially within one end of the base means and operatively connected to said input/output device, and a base height adjustment means operatively connected to the other end of said base means; and a printer means, wherein said printer means is comprised of a second alignment means which interacts with the first alignment means and is further comprised of a receiving means for receiving said locking means.

2. The alignment device, as in claim 1, wherein said locking means is further comprised of:

a latch means.

3. The alignment device, as in claim 1, wherein said base means is constructed of:

a durable, polymeric material.

4. The alignment device, as in claim 1, wherein said base means is further comprised of:

a pivot arm reinforcement means.

5. The alignment device, as in claim 1, wherein said base height measurement means is further comprised of:

a slider means.

6. The alignment device, as in claim 1, wherein said base height measurement means is further comprised of:

a roller means.

7. The alignment device, as in claim 1, wherein said second alignment means is further comprised of:

a hole means.

8. A method for separating and aligning an input/output device and a printer, wherein said method is comprised of the steps of:

operating a releasing means located on a printer and/or an input/output device;

separating said printer and said input/output device;

rotating in a first direction a first alignment means which is hingedly attached to a lower end of said input/output device, wherein said first alignment means is comprised of a unitary base means, a pivot means located substantially within one end of said base means and operatively connected to said input/output device, and a base height adjustment means operatively connected to the other end of said base means;

rotating in a second direction said first alignment means; and aligning said input/output device and said printer such that said first alignment means is guided by and interacts with a second alignment means located substantially on said printer.

* * * * *